US005772471A

United States Patent [19]

Buck

[11] Patent Number: 5,772,471

[45] Date of Patent: Jun. 30, 1998

[54] PANEL MOUNT BRACKET FOR ELECTRICAL CONNECTOR

[75] Inventor: Jonathan Earl Buck, Santa Clara, Calif.

[73] Assignee: The Whitaker Corporation, Wilmington, Del.

[21] Appl. No.: 846,604

[22] Filed: Apr. 30, 1997

Related U.S. Application Data

[63] Continuation-in-part of Ser. No. 742,008, Oct. 31, 1996, Pat. No. 5,709,569.

[51] Int. Cl.[6] ..... H01R 13/648

[52] U.S. Cl. ..... 439/607; 439/939

[58] Field of Search ..... 439/607, 609, 439/939, 527, 533, 569, 573

[56] References Cited

U.S. PATENT DOCUMENTS

| | | | |
|---|---|---|---|
| 5,376,011 | 12/1994 | Rudy, Jr. et al. | 439/79 |
| 5,405,267 | 4/1995 | Koegel et al. | 439/79 |
| 5,591,050 | 1/1997 | Sueoka | 439/607 |
| 5,709,569 | 1/1998 | Buck et al. | 439/607 |

OTHER PUBLICATIONS

*AMP Drawing No. C–787616*, "Receptacle Assembly, Right Angle, 4 Position, Thru–Hole, USB", one page; (1995); AMP Incorporated, Harrisburg, PA.

U.S. Patent Application Ser. No. 08/690,410 filed Jul. 25, 1996 (Abstract and Drawings only included).

*Primary Examiner*—Khiem Nguyen
*Attorney, Agent, or Firm*—Anton P. Ness

[57] ABSTRACT

Bracket (10,80) adapted to be mounted to a conductive panel for mounting a shielded connector (50) thereto, where the connector is of a design intended for mounting to a circuit board but is instead terminated to a cable (70). Upper and lower wall sections (20,22) extend rearwardly from bracket body section (12) each having at least one locking tab (24,26,80) extending forwardly and inwardly almost to body section (12). Connector (50) is urged forwardly against body section (12) until locking tabs (24,26,80) seat behind flanges (62) of connector shield (60) and press against shield (60) to establish ground connections therewith.

5 Claims, 3 Drawing Sheets

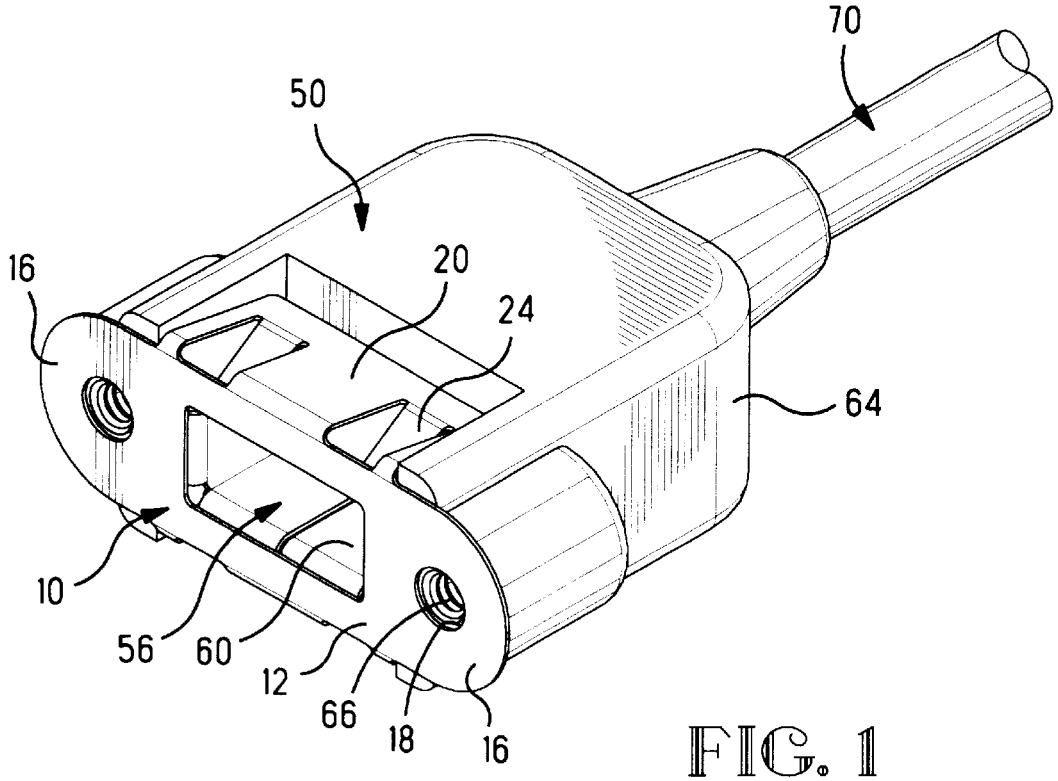
FIG. 1
FIG. 2
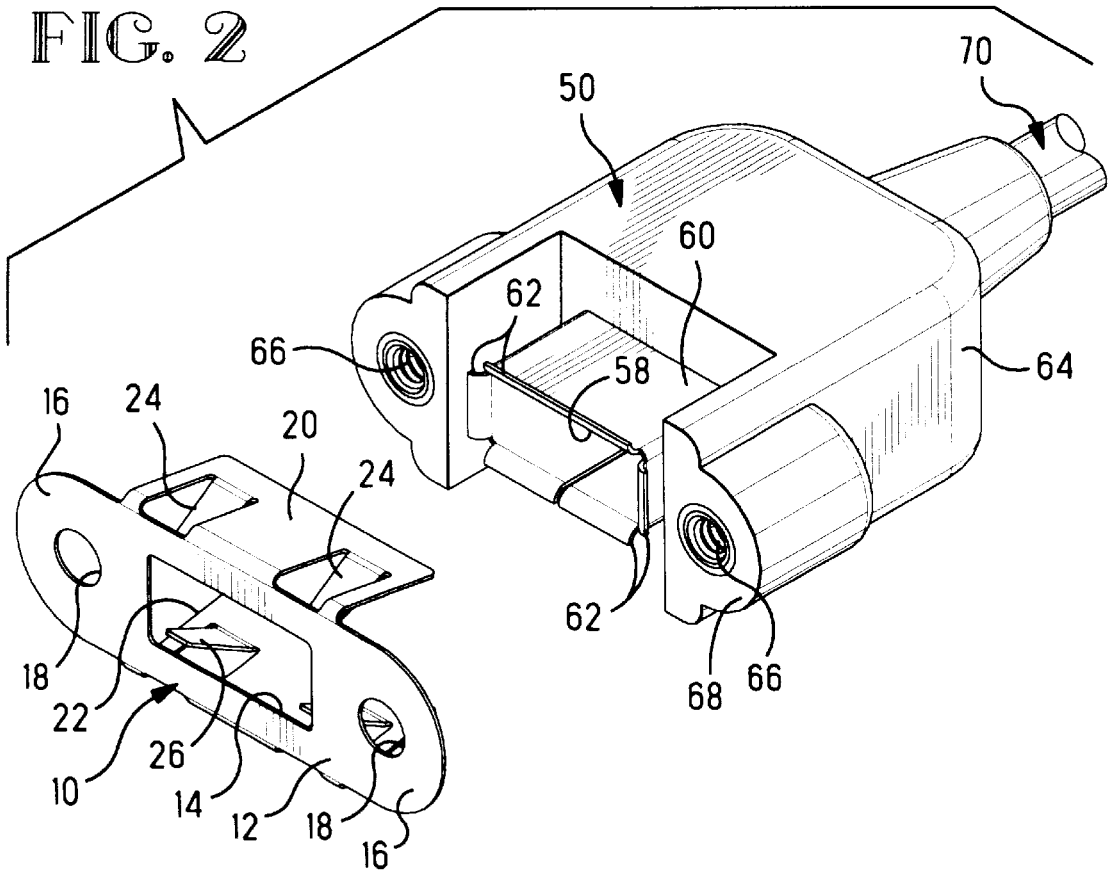

PANEL MOUNT BRACKET FOR ELECTRICAL CONNECTOR

RELATED APPLICATION INFORMATION

This is a continuation-in-part application of U.S. patent application Ser. No. 08/742,008 filed Oct. 31, 1996 now U.S. Pat. No. 5,709,569.

FIELD OF THE INVENTION

This relates to the field of electrical connectors and more particularly to connectors mountable at a panel cutout.

BACKGROUND OF THE INVENTION

In U.S. patent application Ser. No. 08/690,410 filed Jul. 25, 1996 is disclosed an electrical connector mountable within an electronic apparatus such as a computer, at an input/output port thereof, and is mounted onto a circuit board that is fixed within the computer adjacent to a cutout of a conductive panel; the application also discloses a holder for holding two such connectors. A conductive shield of the connector includes a plurality of tabs or flanges extending slightly forwardly of the mating face to surround the periphery of the panel cutout for shielding against electromagnetic/radiofrequency interference (EMI/RFI).

In U.S. patent application Ser. No. 08/742,008 filed Oct. 31, 1996 and assigned to the assignee hereof, a panel mount bracket is disclosed that is affixed to a shielded connector by soldering so that the connector is aligned with a complementary cutout of the bracket, so that any gap between the larger panel opening and the smaller shield of the connector is effectively shielded.

It is desired to provide a mechanism for mounting a connector that is of a design fabricated for mounting to a circuit board, directly to the panel at the cutout after being terminated to a cable.

SUMMARY OF THE INVENTION

The present invention is a bracket affixable to an electrical connector in grounded engagement with the shield thereof, and includes apertures adapted for receipt thereinto of fasteners for fastening the bracket/connector assembly to a panel at a cutout thereof, as well as providing mechanical support to the connector extending from the panel. The bracket includes upper and lower wall sections extending rearwardly from a panel mounting body along which the connector is placed, each having at least one forwardly and inwardly extending locking tab, the tabs latching behind rearwardly facing surfaces at least proximate leading edges of the top and bottom walls of the shield of the connector to secure the bracket in place and preferably press against surfaces of the connector shield to establish grounding connections therewith, with a cutout of the bracket being preferably just smaller than opening defined by the leading edges of the connector shield. The rearwardly facing surfaces may be defined by outwardly turned flanges at leading edges of the shield.

An embodiment of the present invention will now be described by way of example with reference to the accompanying drawings.

BRIEF DESCRIPTION OF THE DRAWINGS

FIG. 1 is an isometric view from forwardly thereof of the bracket of the present invention assembled to a connector terminated to a cable;

FIG. 2 is an isometric view of the assembly of FIG. 1 with the bracket exploded from the connector;

DETAILED DESCRIPTION OF THE EMBODIMENTS

Figure 3:
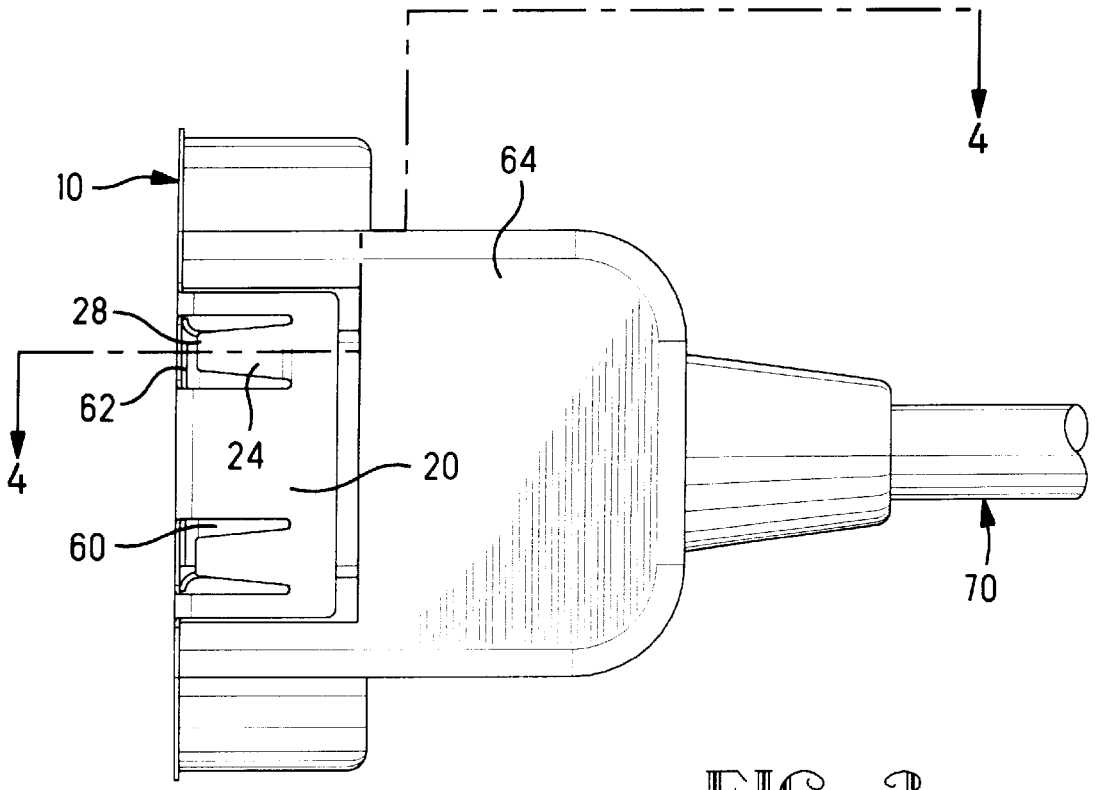
FIG. 3 is a plan view of the connector/bracket assembly.
Figure 4:
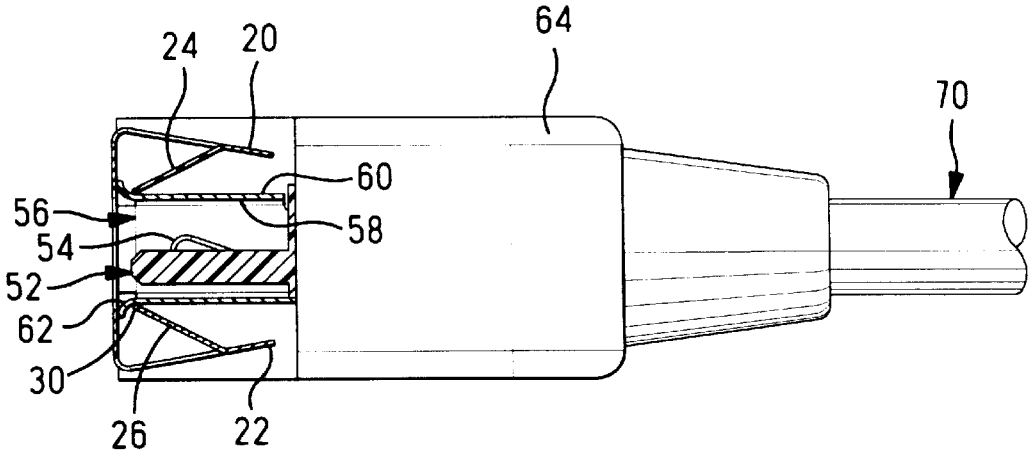
FIG. 4 is a longitudinal section view of the assembly taken along lines 4—4 of FIG. 3.

Bracket 10 comprises a stamped and formed conductive member that adapts a shielded connector 50 generally of an existing design for mounting to a circuit board, for being terminated to a cable 70 rather than to a circuit board, thereby requiring mounting of the connector directly to a conductive panel or chassis. Connector 50 is of the type having an insulative housing 52 containing a plurality of contacts 54 extending from first contact sections at a rear housing face (not shown) to a mating face 56 where contact sections thereof are exposed within a plug-receiving cavity 58 for mating. Plug-receiving cavity 58 is to be aligned with a cutout of a panel, and conductive shield 60 around housing 52 is adapted at mating face 56 with flanges 62 for enhanced EMI/RFI shielding. Generally, connector 50 is similar to the Universal Serial Bus Connector sold by AMP Incorporated, Harrisburg, Pa. as Part No. 787616, that is adapted for mounting to a circuit board (not shown), with the first contact sections being bent to define right-angles to be inserted into and soldered within through-holes of the board.

Bracket 10 includes a panel mounting body 12 having a plug-receiving cutout 14 to be aligned with the panel cutout, and mounting flanges 16 to either side of cutout 14 having apertures 18 therethrough. Optionally apertures 18 may be threaded apertures tapped into embossments formed thereon, into which fasteners are threadable for securing the bracket to the panel, whereby the bracket becomes groundingly engaged with panel.

Upper and lower wall sections 20,22 extend rearwardly from top and bottom edges of body 12 to rearward edges forwardly and inwardly from each of which extend at least one stiffly resilient locking tab 24,26, and preferably a pair of such locking tabs 24,26, having free ends 28,30 extending almost to body 12. Upper and lower wall sections 20,22 define therebetween a connector-receiving region 28 into which is inserted connector 50 for being secured to bracket 10 with plug-receiving cavity 62 aligned with plug-receiving cutout 14 of body 12 and the panel cutout forwardly thereof. As connector 50 is urged against body 12, locking tabs 24,26 are deflected toward upper and lower wall sections 20,22 until passing over flanges 62, whereafter the locking tabs resile against the upper and lower outer surfaces of shield 60 of connector 50 behind flanges 62 and are biased thereagainst.

To adapt connector 50 for termination to cable 70, the first contact sections of contacts 54 are maintained straight instead of being bent to define the right angles for through-hole mounting, and are soldered to conductors of cable 70, while the drain wire of the cable is soldered to shield 60 to establish a ground connection, all as disclosed in U.S. Ser. No. 08/742,008. After wire termination, insulative material is then, preferably, molded in a low pressure process around the rearward end of the connector to define an overmolded housing 64 extending a limited distance forwardly along the connector and rearwardly a distance along the cable end, that adheres to the rearward connector end for insulating the solder terminations of the cable conductors to the first contact sections, and the drain wire to the shield 60. Preferably female threaded inserts 66 are insert molded within overmolded housing 64 along front face 68 thereof to each side of mating face 56 of connector 50, that become aligned with apertures 18 of bracket 10 upon affixing of the bracket to the connector, to receive fasteners when mounting the connector/bracket assembly to the panel.

Panel mounting body 12 of bracket 10 preferably is dimensioned larger than is sufficient to surround the mating face of connector 50, such that the bracket is useful with panels having a cutout larger than is necessary for insertion therethrough of a plug complementary to the plug-receiving cavity of connector 50; and apertures 18 preferably are centered vertically between the top and bottom edges of panel mounting body 12. Bracket 10 may be stamped and formed, for example, from carbon steel 1008 or 1010, Temper 3, that is plated with bright tin-lead.

Figure 5:
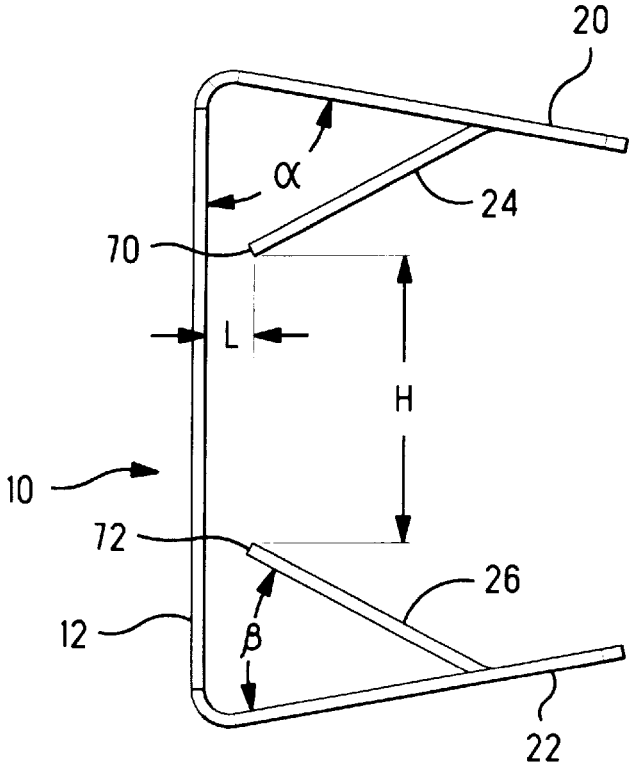
FIG. 5 is a longitudinal section view of the bracket of FIGS. 1 to 4.
Figure 6:
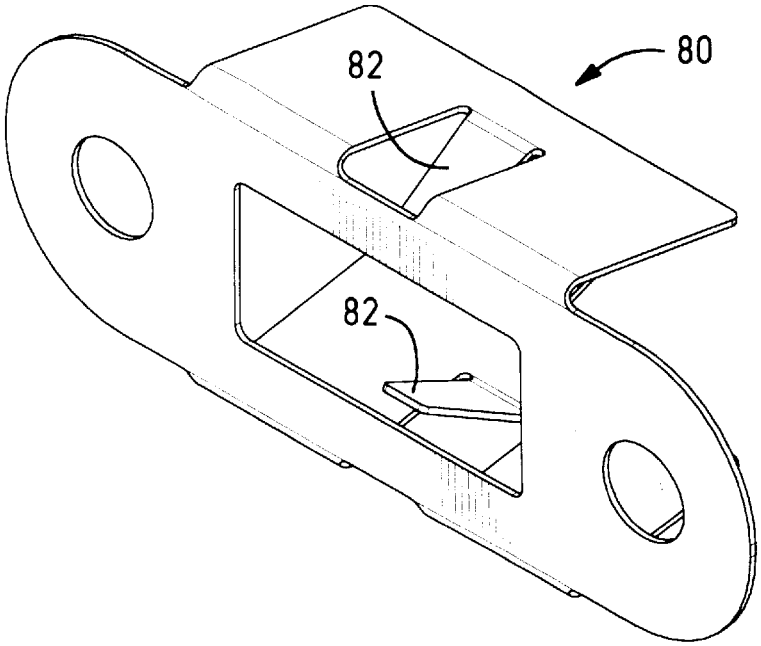
FIG. 6 is an isometric view of a second embodiment of bracket.

Referring to FIG. 5, bracket 10 is stamped and formed preferably with upper and lower wall sections 20,22 angled rearwardly and inwardly from upper and lower edges of panel mounting body 12, such as at an angle $\alpha$ as shown, with locking tabs 24,26 extending forwardly and inwardly at an angle $\beta$. Angle $\alpha$ may be for example, about 80° while angle $\beta$ may be about 42°. Leading ends 70,72 may be a distance H apart and a distance L from panel mounting body 12, where H may be about 0.20 in. and L may be about 0.045 in. when connector 50 has a height of about 0.226 in. FIG. 6 is a second embodiment of bracket 80 having only a single pair of opposed locking tabs 82, useful where the shielded connector has continuous upper and lower outer surfaces.

With the bracket of the present invention, no modification need be made to the connector of an existing board mountable design, nor separate fasteners utilized, while a sturdy attachment is provided to secure the connector to the panel or chassis of the electronic apparatus.

Modifications and variations may be made to the brackets specifically described herein, that are within the spirit of the invention and the scope of the claims.

What is claimed is:

1. A bracket for securing a shielded electrical connector to a panel at an input/output port of an electronic apparatus where the connector shield includes rearwardly facing surfaces at least along upper and lower surfaces at least proximate leading ends thereof, comprising:

an integral member having a panel mount body through which extends a cutout for aligning with the input/output port and having flanges on either side of said cutout with fastener-receiving apertures therethrough for aligning with mounting apertures of said panel; and said integral member further having upper and lower wall sections extending rearwardly from edges of said panel mounting body defining therebetween a connector-receiving region, each said upper and lower wall section including at least one stiffly resilient locking tab extending forwardly and inwardly from a rearward edge thereof, whereby a shielded connector is affixable to said bracket by urging the connector forwardly against the bracket body until the locking tabs latch behind the rearwardly facing surfaces of the connector shield.

2. The bracket as set forth in claim 1 wherein leading ends of opposed ones of said locking tabs are spaced closer together than a height of said connector shield, whereby said locking tabs press against said shield upon assembly.

3. The bracket as set forth in claim 1 wherein said upper and lower walls extend rearwardly and are angled inwardly to rearwardmost edges thereof.

4. The bracket as set forth in claim 1 wherein said upper and lower walls each include a pair of said locking tabs.

5. The bracket as set forth in claim 1 wherein said upper and lower walls each include only a single said locking tab.

* * * * *